US006114079A

United States Patent [19]

Christian et al.

[11] Patent Number: 6,114,079

[45] **Date of Patent: *Sep. 5, 2000**

[54] ELECTRICALLY-CONDUCTIVE LAYER FOR IMAGING ELEMENT CONTAINING COMPOSITE METAL-CONTAINING PARTICLES

[75] Inventors: Paul A. Christian, Pittsford; Debasis Majumdar, Rochester; Ibrahim M. Shalhoub, Pittsford; Dennis J. Eichorst, Fairport, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/053,563

[22] Filed: Apr. 1, 1998

[51] Int. Cl.[7] ..... G03C 1/89; G03C 1/85; G03C 8/52; G03C 11/22; B41J 3/407

[52] U.S. Cl. ..... 430/201; 430/211; 430/212; 430/527; 430/529; 430/530; 430/631; 241/184; 347/105; 347/106

[58] Field of Search ..... 430/527, 530, 430/631, 546, 201, 211, 212, 529; 241/184; 347/105, 106

[56] References Cited

U.S. PATENT DOCUMENTS

| | | | |
|---|---|---|---|
| 3,525,621 | 8/1970 | Miller | 430/527 |
| 4,173,480 | 11/1979 | Woodward | 430/536 |
| 4,275,103 | 6/1981 | Tsubusaki et al. | 430/67 |
| 4,373,013 | 2/1983 | Yoshizumi | 428/570 |
| 4,394,441 | 7/1983 | Kawaguchi et al. | 430/530 |
| 4,416,963 | 11/1983 | Takimoto et al. | 430/530 |
| 4,418,141 | 11/1983 | Kawaguchi et al. | 430/530 |
| 4,431,764 | 2/1984 | Yoshizumi | 504/409 |
| 4,452,830 | 6/1984 | Yoshizumi | 427/215 |
| 4,495,276 | 1/1985 | Takimoto et al. | 430/530 |
| 4,568,609 | 2/1986 | Sato et al. | 428/203 |
| 4,571,361 | 2/1986 | Kawaguchi et al. | 428/328 |
| 4,705,746 | 11/1987 | Tamagawa et al. | 430/538 |
| 4,880,703 | 11/1989 | Sakamoto et al. | 430/530 |
| 4,895,792 | 1/1990 | Aizawa et al. | 430/530 |
| 4,917,952 | 4/1990 | Katamoto et al. | 428/403 |
| 4,940,654 | 7/1990 | Diehl et al. | 430/522 |
| 4,999,276 | 3/1991 | Kuwabara et al. | 430/530 |
| 5,045,394 | 9/1991 | Saverin et al. | 430/527 |
| 5,075,164 | 12/1991 | Bowman et al. | 430/527 |
| 5,122,445 | 6/1992 | Ishigaki | 430/530 |
| 5,244,728 | 9/1993 | Bowman et al. | 430/527 |
| 5,273,822 | 12/1993 | Hayashi et al. | 428/389 |
| 5,294,525 | 3/1994 | Yamauchi et al. | 430/530 |
| 5,322,561 | 6/1994 | Prengel et al. | 106/475 |
| 5,340,676 | 8/1994 | Anderson et al. | 430/530 |
| 5,350,448 | 9/1994 | Dietz et al. | 106/441 |
| 5,368,995 | 11/1994 | Christian et al. | 430/530 |
| 5,382,494 | 1/1995 | Kudo et al. | 430/523 |
| 5,385,968 | 1/1995 | Bowman et al. | 524/493 |
| 5,405,907 | 4/1995 | Bowman et al. | 430/523 |
| 5,459,021 | 10/1995 | Ito et al. | 430/527 |
| 5,466,536 | 11/1995 | Berner et al. | 430/527 |
| 5,466,567 | 11/1995 | Anderson et al. | 430/530 |
| 5,472,640 | 12/1995 | Bruckner et al. | 252/518 |
| 5,478,705 | 12/1995 | Czekai et al. | 430/449 |
| 5,480,752 | 1/1996 | Nishikiori et al. | 430/49 |
| 5,484,694 | 1/1996 | Lelental et al. | 430/530 |
| 5,488,461 | 1/1996 | Go et al. | 430/56 |
| 5,500,331 | 3/1996 | Czekai et al. | 430/449 |
| 5,513,803 | 5/1996 | Czekai et al. | 241/16 |
| 5,585,037 | 12/1996 | Linton | 252/518 |
| 5,628,932 | 5/1997 | Linton | 252/518 |
| 5,651,813 | 7/1997 | Santilli et al. | 106/31.67 |
| 5,662,279 | 9/1997 | Czekai et al. | 241/21 |
| 5,677,039 | 10/1997 | Perrin et al. | 428/205 |
| 5,679,138 | 10/1997 | Bishop et al. | 106/20 C |
| 5,683,862 | 11/1997 | Majumdar et al. | 430/530 |
| 5,700,623 | 12/1997 | Anderson et al. | 430/256 |
| 5,719,016 | 2/1998 | Christian et al. | 430/530 |
| 5,866,287 | 2/1999 | Christian et al. | 430/530 |
| 5,905,021 | 5/1999 | Anderson et al. | 430/529 |
| 5,912,109 | 6/1999 | Anderson et al. | 430/529 |
| 5,955,250 | 9/1999 | Christian et al. | 430/530 |

FOREIGN PATENT DOCUMENTS

| | | |
|---|---|---|
| 616252 | 9/1994 | European Pat. Off. . |
| 649858 | 4/1995 | European Pat. Off. . |
| 1-262537 | 10/1989 | Japan . |
| 4-055492 | 6/1990 | Japan . |

OTHER PUBLICATIONS

British Patent Abstract 2,253,839, Feb. 22, 1995.
Japan Kokai 59–10280, Jan. 19, 1984 (English Abstract).
Japan Kokai 61–26933, Feb. 6, 1986 (English Abstract).
Japan Kokai 62–59528, Mar. 16, 1987 (English Abstract).
Japan Kokai 02–601887, Apr. 16, 1997 (English Abstract).

*Primary Examiner*—Richard L. Schilling
*Attorney, Agent, or Firm*—Carl F. Ruoff; Doreen M. Wells

[57] ABSTRACT

The present invention is an imaging element including a support having a frontside and a backside, an imaging layer superposed on the frontside of said support, and a print-retaining, electrically-conductive layer superposed on the backside of the support. The electrically-conductive layer includes a film-forming binder comprising the latex polymeric addition product of from 20 to 65 mol % of styrene, from 30 to 78 mol % of n-butyl methacrylate, and from 2 to 10 mol % of the sodium salt of 2-sulfoethyl methacrylate. and at least about 60 weight percent composite electrically conductive particles. The composite electrically-conductive particles have a layer of electrically-conductive metal-containing crystallites overlying a nonconductive substrate particle. The electrically-conductive layer is formed by dispersing the composite electrically-conductive particles using polymeric milling media having a mean particle size less than 350 $\mu$m to form a colloidal dispersion, combining the colloidal dispersion with the film forming binder to form a mixture, coating the mixture onto the support and drying the mixture to form the electrically-conductive layer.

20 Claims, No Drawings

ELECTRICALLY-CONDUCTIVE LAYER FOR IMAGING ELEMENT CONTAINING COMPOSITE METAL-CONTAINING PARTICLES

CROSS REFERENCE TO RELATED APPLICATIONS

This application relates to commonly assigned copending application Ser. No. 09/053,233, filed simultaneously herewith and hereby incorporated by reference for all that it discloses. This application relates to commonly assigned copending application Ser. No. 09,053,514, filed simultaneously herewith and hereby incorporated by reference for all that it discloses.

FIELD OF THE INVENTION

This invention relates to improved electrically-conductive layers for an imaging element exhibiting both antistatic and print retaining capabilities. More particularly, this invention relates to an electrically-conductive layer applied to one side of a polyolefin-coated photographic paper support which can provide protection from the accumulation and discharge of electrostatic charge and also receive and retain various types of markings or indica using printing ink and the like and also maintain these properties after photographic processing.

BACKGROUND OF THE INVENTION

In order to minimize problems arising from electrostatic charging during the manufacture and use of imaging elements various well known methods can be used to introduce an electrically-conductive layer into an imaging element to dissipate accumulated static charge. In the case of a photographic element, the electrically-conductive layer can be a subbing layer, an intermediate layer, and especially an outermost layer either overlying a silver halide emulsion layer or a backing layer on the opposite side of the support from the silver halide emulsion layer(s). For typical polyolefin-coated photographic papers, this electrically-conductive layer is applied to the support as an antistatic backing layer. In addition to providing suitable charge dissipation properties, such backing layers must also provide the ability to receive printed information (e.g., bar codes, alphanumeric data or other types of indicia or identification) typically applied by means of dot matrix or inkjet printers as well as the ability to retain both antistatic and print-retaining properties after the paper has been subjected to photographic processing (viz., "backmark retention"). Further, such conductive print-retaining backing layers also must exhibit suitable physical properties in order to enable heat or tape splicing and to minimize dusting or trackoff during conveyance. Heat splicing of rolls of photographic paper is often performed during printing operations and requires sufficient mechanical strength to resist peeling as the web is conveyed through automatic high speed photographic processing equipment. Failure caused by poor splice strength can result in poor conveyance of the web leading to jamming of the processing equipment. In addition, trackoff or pick off of material from the backing layer during conveyance can result in an undesirable build-up of particulate debris on conveyance rollers and other contact surfaces which can produce surface defects in the product.

A wide variety of conductive antistatic agents can be incorporated in antistatic layers to produce a broad range of surface electrical conductivities. Many of the traditional antistatic layers used in photographic elements employ materials which exhibit predominantly ionic conductivity.

Antistatic layers containing simple inorganic salts, alkali metal salts of surfactants, alkali metal ion-stabilized colloidal metal oxide sols, ionic conductive polymers or polymeric electrolytes containing alkali metal salts and the like have been taught in prior art. The electrical conductivities of such ionic conductors are typically strongly dependent on the temperature and relative humidity of the surrounding environment. At low relative humidities and temperatures, the diffusional mobilities of the charge-carrying ions are greatly reduced and the bulk conductivity is substantially decreased. Because of the aqueous solubility and ion-exchange properties of such materials, unprotected antistatic layers containing ionic conductors typically do not exhibit antistatic properties after photographic processing.

U.S. Pat. No. 3,525,621 discloses that antistatic properties can be provided for photographic paper by applying a layer containing an aqueous colloidal silica sol, preferably one consisting of silica particles having a specific surface area of about 200–235 $m^2/g$, in combination with an alkylaryl polyether sulphonate. However, because of the high solubility of such an alkylaryl polyether sulphonate in aqueous media, it can be leached out during processing resulting in poor backmark retention by the layer. Further, antistatic backing layers for photographic papers containing colloidal silica without a polymeric binder typically exhibit microcracks upon drying which can lower the surface conductivity. Calcium stearate from the paper base can leach out through these microcracks during photographic processing and deposit stearate sludge in the processing tanks, which can require costly clean-up operations. In addition, such colloidal silica-based antistatic backing layers typically exhibit poor backmark retention.

The use of synthetic hectorite clay particles as an antistatic additive to a silica-containing antistatic layer for photographic paper is taught in U.S. Pat. No. 4,173,480. However, the hydrophilicity and other surface properties of the synthetic hectorite clay results in poor backmark retention.

Writeable, antistatic backcoatings for polyolefin-coated photographic paper containing one or more water-soluble or latex polymeric binders in combination with a cation-modified colloidal silica and an alkali salt were disclosed in U.S. Pat. Nos. 4,705,746; 4,895,792; and 5,045,394. For, example, the backcoatings of U.S. Pat. No. 5,045,394 were disclosed to exhibit good printability, writeability, minimal dyestain in developing solutions, good tape adhesion, and adequate antistatic characteristics. However, antistatic properties of such backcoatings typically are lost after photographic processing.

A print-retaining layer for polyolefin resin-coated photographic paper containing a granular tooth-providing ingredient in a polymeric binder consisting of an addition product of an alkyl methacrylate, an alkali salt of an ethylenically unsaturated sulfonic or carboxylic acid, a vinyl benzene monomer, and an ethylenically unsaturated crosslinking agent is disclosed in U.S. Pat. Nos. 5,075,164 and 5,405,907. Although the print-retaining layer provides adequate backmark retention for use with most automatic processors, the layer can be damaged or entirely removed, resulting in poor backmark retention, when passed through automatic processors having harsher operating conditions. Also, photographic elements having such print-retaining layers can exhibit various deficiencies, such as blocking, incompatibility of ingredients, and pickoff during manufacture.

U.S. Pat. Nos. 5,244,728 and 5,385,968 disclose the use of aqueous coating formulations containing aluminamodified colloidal silica in combination with an antistatic agent consisting of a non-ionic polymer in conjunction with an alkali metal salt, for example, polyethylene ether glycol and lithium nitrate, and a polymeric binder consisting of an addition product of alkyl methacrylate, an alkali metal salt, and a vinyl benzene to prepare antistatic backing layers for photographic paper. Although these backing layers provide adequate backmark retention properties, antistatic protection is provided only before processing since the metal salts used as antistatic agents are soluble in processing solutions. Further such backing layers are unsuitable because they lack sufficient mechanical integrity as demonstrated by poor spliceability and excessive track off properties.

An antistatic layer for use on polyolefin resin-coated photographic paper containing a polymeric latex binder and a non-ionic surface-active compound including poly (ethylene oxide) and alkali metal salt wherein the non-ionic surface-active compound is present at between 0.1 and 4 percent of the dry weight of the antistatic layer is disclosed in U.S. Pat. No. 5,683,862. Such antistatic layers exhibit improved spliceability and trackoff properties as well as acceptable post-processing backmark retention. However, the antistatic properties of such layers are substantially diminished after photographic processing.

Antistatic layers containing electronic conductors such as conjugated conductive polymers, conductive carbon particles, crystalline semiconductor particles, amorphous semiconductive fibrils, and continuous semiconductive thin films can be used more effectively than ionic conductors to dissipate static charge since their electrical conductivity is independent of relative humidity and only slightly influenced by ambient temperature. Of the various types of electronic conductors, electrically-conductive metal-containing particles, such as semiconductive metal oxides, are particularly effective when dispersed with suitable polymeric film-forming binders in combination with polymeric non-film-forming particles as described in U.S. Pat. Nos. 5,340,676; 5,466,567; 5,700,623. Binary metal oxides doped with appropriate donor heteroatoms or containing oxygen deficiencies have been disclosed in prior art to be useful in antistatic layers for photographic elements, for example: U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; 5,484,694; and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include Sb-doped tin oxide, F-doped tin oxide, Al-doped zinc oxide, and Nb-doped titania. Additional preferred conductive ternary metal oxides disclosed in U.S. Pat. No. 5,368,995 include zinc antimonate and indium antimonate. Other conductive metal-containing granular particles including metal borides, carbides, nitrides, and suicides have been disclosed in Japanese Kokai No. JP 04-055,492.

One serious deficiency of such electronic conductor materials is that, especially in the case of semiconductive metal-containing particles, the particles typically are intensely colored (i.e., black, gray, blue, green, yellow, etc.) which renders them unsuitable for use in coated layers on many photographic paper supports, particularly at high weight loadings or dry weight coverages. However, composite conductive particles consisting of a thin layer of conductive metal-containing particles deposited onto the surface of non-conductive core particles can exhibit much lighter color while retaining much of the bulk conductivity of homogeneous conductive metal-containing particles described hereinabove. For example, composite conductive particles consisting of two dimensional networks of fine antimony-doped tin oxide crystallites in association with amorphous silica deposited on the surface of much larger, non-conductive metal oxide particles (e.g., silica, titania, etc.) and a method for their preparation are disclosed in U.S. Pat. Nos. 5,350,448; 5,585,037; and 5,628,932. Other suitable composite conductive granular particles include titanium dioxide particles having a uniform and strongly adherent thin layer of antimony or fluorine-doped tin oxide formed on their surfaces as disclosed in U.S. Pat. Nos. 4,373,013 and 4,452,830; inorganic titanate particles (e.g., barium titanate, strontium titanate, calcium titanate, magnesium titanate, etc.) with coatings of antimony-doped tin oxide and dense amorphous silica as disclosed in British Patent No. 2,253,839; iron oxide particles coated with antimony-doped tin oxide particles as disclosed in U.S. Pat. No. 4,917,952; granular barium sulfate particles coated with a thin layer of antimony or fluorine-doped tin oxide as disclosed in U.S. Pat. No. 5,585,037; and platelet-like or lamellar non-conductive particles (e.g., talc, mica, kaolinite, bentonite, montmorillonite, smectite clay, hematite) coated with a thin conductive layer of antimony-doped tin oxide as described in U.S. Pat. Nos. 4,568,609; 4,917,952; 5,322,561; 5,472,640; 5,585,037; and 5,677,039; for example. Such composite conductive particles are disclosed in U.S. Pat. Nos. 4,373,013; 5,466,536; 5,488,461; and British Patent No. 2,253,839 to be useful in conductive backing layers on photographic, electrographic, and electrophotographic support materials, especially resin-coated photographic paper. Also, fibrous or needle-like conductive materials including composite conductive particles consisting of acicular or fibrous nonconductive metal oxide core particles, such as $TiO_2$, $K_2Ti_6O_{13}$, $9Al_2O_3.2B_2O_3$, $2Al_2O_3.B_2O_3$ or $2MgO.B_2O_5$ coated with a thin conductive layer of antimony-doped tin oxide or zinc oxide have been described in U.S. Pat. Nos. 4,880,703; 5,273,822; and Japanese Kokai Nos. Sho 59-10280, 61-26933, and 62-59528. Such acicular or fibrous composite conductive particles can be used in conductive backing layers for photographic papers as disclosed in U.S. Pat. No. 5,466,536; European Patent Application No. 616,252; and Japanese Kokai Nos. Sho 01-262537.

However, there is difficulty in the preparation of conductive backings containing composite conductive particles, in that the dispersion of composite conductive particles of the type described hereinabove, especially acicular or fibrous composite conductive particles, in an aqueous vehicle using conventional wet milling dispersion techniques and traditional ceramic or steel milling media is well known to be very difficult to accomplish without abrading the thin conductive layer from the core particle or shattering the high aspect ratio acicular core particles into lower aspect ratio fragments. Fragile composite conductive particles often cannot be dispersed effectively because of limitations on milling intensity and duration dictated by the need to minimize degradation of the morphology and electrical properties as well as the introduction of attrition-related contamination from the dispersion process. The presence of colloidal ceramic particles from the attrition of conventional ceramic media can promote destabilization of the dispersion leading to heteroflocculation. Further, as described in U.S. Pat. No. 5,480,752, the use of conventional dispersing agents in the dispersion process can produce unstable dispersions which flocculate and settle rapidly. The use of such low stability dispersions to prepare conductive layers for imaging elements can produce nonhomogeneities in the coated layers leading to decreased conductivity and increased optical losses due to scattering by agglomerates or aggregates of particles.

The preparation of dispersions of submicron-size particles of crystalline materials useful in imaging elements (e.g., filter dyes, sensitizing dyes, image-forming couplers, antifoggants, etc.) by comminution using conventional wet milling techniques well known in the pigment and paint industry, such as high-speed mixing, ball or roller milling or high energy media milling, has been disclosed in U.S. Pat. Nos. 4,940,654; European Application No. 649,858 and Japanese Examined Application No. 02-601,887. Such comminution processes involve physical attrition of the material useful in imaging elements using milling media generally selected from a variety of dense, hard materials, such as steel, ceramic or glass. The action of such milling media on the particulate materials results in particle size reduction as well as dispersion. The resulting fine particle dispersions can be stabilized using a variety of surfactants or dispersing aids to prevent re-agglomeration of the dispersed fine particles. It also may be necessary to adjust pH during the milling process to stabilize the dispersion. The milling energy input levels required to produce dispersions of very small size particles can result in the generation of excessive amounts of attrition-related contamination from erosion of the milling media and wear of components of the milling equipment. Such attrition-related contamination is usually present in the form of dissolved species or particulates of sizes comparable to or larger than those of the dispersed particles and can lead to both physical and sensitometric defects in imaging elements containing these contaminated dispersions. Further, heat generated during high intensity milling operations may initiate chemical reactions, introduce surface defects or promote phase changes in the material being dispersed. Thus, the physical, chemical, electrical, optical, and mechanical properties of the dispersed particles may differ substantially from those of the particulate materials before milling. Such variations in properties can adversely affect the performance of imaging elements including layers prepared from dispersions of these materials.

A method for preparing dispersions of submicron-size particles of crystalline materials useful in imaging elements by a wet milling process using small milling media consisting of fine polymeric resin beads that results in reduced levels of attrition-related contamination in the dispersions has been disclosed in U.S. Pat. Nos. 5,478,705; 5,500,331; 5,513,803; and 5,662,279. Such polymeric milling media consist essentially of a polymeric resin and are nominally spherical in shape, chemically and physically inert, substantially free of metals, solvents or monomers, and are sufficiently hard to avoid being chipped or crushed during the dispersion process. Suitable polymeric milling media are typically less than about 250 $\mu$m in diameter. Compounds useful in imaging elements that can be dispersed using polymeric milling media are claimed in U.S. Pat. No. 5,478,705 and include dye-forming couplers, development inhibitor release couplers, development inhibitor anchimeric release couplers, masking couplers, filter dyes, thermal transfer dyes, optical brighteners, nucleators, development accelerators, oxidized development scavengers, ultraviolet radiation absorbing compounds, sensitizing dyes, development inhibitors, antifoggants, bleach accelerators, magnetic particles, lubricants, and matting agents. Further, polymeric milling media can be used to prepare aqueous dispersions of submicron size particles of organic pigments suitable for use in inkjet inks, as disclosed in U.S. Pat. Nos. 5,651,813 and 5,679,138. However, the utility of polymeric milling media for dispersing electrically-conductive metal-containing composite particles, for inclusion in antistatic backing layers or electrodes for imaging elements has been neither disclosed nor contemplated in prior art.

Thus, one object of the present invention is to provide an effective antistatic backing layer on an imaging element having an opaque or translucent support, particularly a polyolefin resin-coated photographic paper, with suitable backmark receiving and retention properties. The present invention finds particular utility in the photofinishing industry by enabling the printing of alphanumeric characters, barcodes, indicia or other markings onto the back of photographic paper prints using dot matrix or inkjet printers, for example. Photofinishing requirements are particularly stringent because such backing layers must survive photographic processing by automatic processing equipment under harsh conditions in order to be useful. Another object of the present invention is to provide an electrically-conductive layer on a surface to which print or ink markings can be applied, for example by inkjet or thermal printing, wherein the original surface does not possess the desired wetting, spreading, drying or adhesion properties necessary to ensure the clarity and permanence of the applied markings.

Because the requirements for electrically-conductive backing layers to be useful in a photographic element are extremely demanding, the art has long sought to develop improved conductive layers exhibiting a balance of the necessary chemical, physical, optical, and electrical properties. As indicated hereinabove, the prior art for providing electrically-conductive layers useful for photographic elements is extensive and a wide variety of suitable electroconductive materials have been disclosed. However, there is still a critical need in the art for improved conductive backing layers for photographic papers which can be manufactured at a reasonable cost, which are resistant to the effects of humidity change, which are durable and abrasion-resistant, which are transparent or translucent, which are colorless or lightly colored, which do not exhibit adverse sensitometric or photographic effects, which exhibit acceptable adhesion to the support or an underlying layer, which exhibit suitable cohesion, acceptable heat spliceability, good trackoff characteristics, and which retain their antistatic properties and backmark receiving and retention properties after photographic processing.

It is toward the objective of providing conductive backing layers for imaging elements, especially polyolefin-coated photographic paper, having composite metal-containing conductive particles dispersed in a polymeric film-forming binder without causing degradation of either the physical or electrical properties of the composite conductive particles or introducing attrition-related contamination during the dispersion process that more effectively meet the diverse needs of such imaging elements than those of the prior art that the present invention is directed.

SUMMARY OF THE INVENTION

The present invention is an imaging element including a support having a frontside and a backside, an imaging layer superposed on the frontside of said support, and a print-retaining, electrically-conductive layer superposed on the backside of the support. The electrically-conductive layer includes a film-forming binder comprising the latex polymeric addition product of from 20 to 65 mol % of styrene, from 30 to 78 mol % of n-butyl methacrylate, and from 2 to 10 mol % of the sodium salt of 2-sulfoethyl methacrylate and at least about 60 weight percent composite electrically conductive particles. The composite electrically-conductive particles have a layer of electrically-conductive metal-containing crystallites overlying a nonconductive substrate particle. The electrically-conductive layer is formed by dispersing the composite electrically-conductive particles using polymeric milling media having a mean particle size less than 350 μm to form a colloidal dispersion, combining the colloidal dispersion with the film forming binder to form a mixture, coating the mixture onto the support and drying the mixture to form the electrically-conductive layer.

DETAILED DESCRIPTION OF THE INVENTION

This invention provides an imaging element including a translucent, opaque or reflective support, such as paper, synthetic paper, polyolefin resin coated paper or laminated paper; a print-retaining, electrically-conductive layer, wherein the electrically-conductive layer contains nominally spherical or granular, platey, lamellar, fibrous or acicular electrically-conductive, metal-containing composite particles dispersed in a film-forming polymeric binder; and an image forming or image receiving layer.

Electrically-conductive layers of this invention are broadly applicable to photographic, electrophotographic, electrostatographic, photothermographic, electrothermographic, dye migration, dielectric recording, inkjet, laser dye ablation and thermal-dye-transfer imaging elements. Details with respect to the composition and function of this wide variety of imaging elements are provided in U.S. Pat. No. 5,719,016, for example. Such conductive layers are particularly useful for solution-processed photographic papers having a silver halide sensitized emulsion layer located on the side of the support opposite the electrically-conductive layer. Such photographic papers typically have a polyolefin resin coating applied to one or both free surfaces of the support. Further, the conductive backing layers of this invention can survive photographic processing by automatic processing equipment under harsh conditions and provide the ink receiving, spreading, drying, and adhesion properties necessary to ensure the clarity and permanence of alphanumeric characters, barcodes, indicia or other markings applied to the back of photographic paper prints using dot matrix or inkjet printers.

As described hereinabove, the electrically-conductive backing layer of this invention contains fine, metal-containing, composite conductive particles dispersed in a film-forming polymeric binder. Such composite conductive particles typically have a thin layer of fine conductive crystallites deposited on the surface of other larger, non-conductive substrate or core particles with one or more optional intermediate layers consisting of crystalline or amorphous fine particles interposed between the outer conductive layer and the nonconductive substrate. Suitable nonconductive core particles can be nominally spherical, granular, plate-like, lamellar, acicular, or fibrous in shape. Materials suitable for nominally spherical or granular non-conductive core particles include silica, titania, alumina, iron oxide, barium titanate, strontium titanate, calcium titanate, magnesium titanate, barium sulfate, calcium sulfate, barium carbonate, glass or polymeric beads, and the like. Materials suitable as platey or lamellar nonconductive core particles include talc, natural or synthetic mica, fluoromica, illite, bravaisite, kaolin, swellable phyllosilicates such as bentonite, montmorillonite, hectorite, synthetic smectite clay, titanium oxide, hematite, bismuth oxychloride, thin glass flakes, and the like. Suitable materials for acicular nonconductive core particles include titania, alkali metal titanates (e.g., sodium, potassium, etc.), tin oxide, iron oxides (e.g., maghemite, magnetite, goethite, lepidicrocite, etc.), aluminum borate, and the like. Suitable conductive crystallite materials overlying the nonconductive substrates include antimony-doped tin oxide, fluorine-doped tin oxide, tin-doped indium sesquioxide, niobium-doped titanium dioxide, aluminum-doped zinc oxide, zinc antimonate, indium antimonate, cadmium stannate, cadmium indate, cadmium indium stannate, cadmium antimony stannate, indium gallium oxide, and other conductive metal-containing oxides, as well as conductive metal-containing non-oxides such as metal-containing nitrides, carbides or borides. Suitable materials for the optional intermediate layer or layers include amorphous or crystalline silica, titania, zirconia, alumina, tin oxide, antimony oxide, zinc oxide and the like.

Examples of preferred granular composite conductive particles include antimony-doped tin oxide-coated titania particles such as those available commercially from Dupont Chemicals under the tradename "ZELEC ECP 3410-T", Mitsubishi Materials Corp. under the tradename "W-1", Ishihara Sangyo Corp. under the tradename "ET-500W", and Titan Kogyo under the tradename ECTT-1 as well as antimony-doped tin oxide coated-barium sulfate particles available commercially from Mitsui Metals under the tradename "PASTRAN IV" and and also from Sachtleben Chemie GmbH under the tradename "SACON P401". In addition, "coreless" composite conductive particles including an antimony-doped tin oxide layer coated onto a silica intermediate layer overlying a barium or calcium carbonate substrate particle which is removed by dissolution to form a conductive hollow shell are available from Dupont Chemicals under the tradename "ZELEC ECP 3610-S", for example. Examples of preferred acicular composite conductive particles include antimony-doped tin oxide-coated titania particles such as those available from Ishihara Techno Corp. under the tradename "FT-1000 and FT-2000", antimony-doped tin oxide-coated potassium hexatitanate particles available from Otsuka Chemical Co. under the tradename "DENTALL WK-100 and WK-200", and antimony-doped tin oxide-coated aluminum borate particles available from Mitsui Metals under the tradename "PASTRAN V". Examples of preferred plate-like or lamellar composite conductive particles include antimony-doped tin oxide-coated mica particles available from Dupont Chemicals under the tradename "ZELEC ECP 1410-M" and also from Merck KGaA (EM Industries, Inc.) under the tradename "MINATEC 31 CM and 40 CM".

The average dimensions of composite conductive particles suitable for use in the conductive print-retaining backing layers of this invention can vary widely depending on the shape and composition of the particular substrate particles. For example, the suitable particle size for granular composite conductive particles such as antimony-doped tin oxide-coated titania, silica or barium sulfate particles can range from 0.1 to 2 μm. For platey or lamellar composite conductive particles such as mica, suitable particles can have a major axis ranging from 0.5–20 μm, a minor axis ranging from 0.5μ20 μm, and a thickness ranging from 0.05 to 0.3 μm, for example. For platey or lamellar composite conductive particles such as smectite clays, suitable particles can have a major axis ranging from 0.025–1 μm, a minor axis ranging from 0.025–1 μm, and a thickness ranging from 0.001 to 0.02 μm, for example. For acicular composite conductive particles such as antimony-doped tin oxide coated titania or potassium hexatitanate acicular core particles, suitable particles can have a length ranging from 0.5–10 μm and a diameter ranging from 0.05–1 μm, for example. In order to minimize light scattering and maximize surface smoothness of the conductive backing layers of this invention, it is preferred to uparticlesite conductive particles with average dimensions of about 1 μm or less.

The composite conductive particles can constitute from about 5 to 70 percent, preferably from about 10 to 50 percent, of the volume of the conductive layer of this invention. The amount of composite conductive particles contained in the conductive layer is defined in terms of volume percent rather than weight percent since the range of weight densities for suitable composite conductive particles is wide (i.e., 3 to 7 g/cm$^3$). For the granular antimony-doped tin oxide-coated titania-type composite conductive particles described hereinabove, the preferred volume percentage range corresponds to composite conductive particle to polymeric binder weight ratios ranging from approximately 1:3 to 4:1. Preferably, the weight ratio is at least 1.5:1. The optimum ratio of composite conductive particles to binder varies depending on particle size, particle shape (i.e., granular, plate-like, acicular, etc.), binder type, and the conductivity requirements of the particular imaging element. Use of significantly less than about 10 volume percent of composite conductive particles will not provide a useful level of surface electrical conductivity. Use of significantly more than about 70 volume percent of composite conductive particles can result in diminished adhesion between the conductive layer and the support as well as decreased cohesion in the conductive layer, which can result in poor backmark retention as well as increased dusting and trackoff. Also at high volume percentages the color of the conductive layer may be too intense for certain imaging applications.

Metal-containing composite conductive particles suitable for use in conductive backing layers of this invention can be dispersed by any of various wet milling processes well-known in the art of pigment dispersion and paint making using fine polymeric milling media in the presence of appropriate levels of optional dispersing aids, colloidal stabilizers or polymeric binders. The use of fine polymeric milling media to disperse the fragile metal-containing composite conductive particles minimizes abrasion of the thin conductive coatings on the composite particles thereby preserving the required electrical properties and especially in the case of acicular particles, also minimizes physical degradation of the aspect ratio of the particles. Liquid vehicles suitable for preparing dispersions of composite conductive particles include water; aqueous salt solutions; alcohols such as methanol, ethanol, propanol, butanol; ethylene glycol; and other such solvents. Water and alcohols are the preferred liquid vehicles for dispersion. Suitable dispersing aids can be chosen from a wide variety of surfactants and surface modifiers such as those described in U.S. Pat. Nos. 5,145,684, for example. Typically, the dispersing aid is present in an amount ranging from 0.1 to 10% of the dry weight of the composite conductive particles.

Polymeric milling media used to disperse composite conductive particles in accordance with this invention are preferably nominally spherical in shape, such as polymeric resin beads. Suitable polymeric media have a density ranging from 0.8 to about 3 g/cm$^3$. For dispersion of the composite conductive particles of this invention, low density polymeric media are preferred. Although higher density milling media can provide more efficient dispersion as well as particle size reduction, the use of such media is particularly disadvantageous for acicular composite conductive particles. Polymers suitable for use as polymeric milling media are chemically and physically inert, substantially free from metals, solvents, and monomers, and of sufficient hardness and toughness to avoid being fractured, chipped or crushed during the dispersion process. Suitable polymers include cross-linked polystyrenes, such as polystyrene cross-linked with divinyl benzene, styrene copolymers, polycarbonates, polyacetals, such as Delrin™, vinyl chloride polymers and copolymers, polyurethanes, polyaramides, poly(tetrafluoroethylenes), e.g., Teflon™, and other fluoropolymers, high density polyethylenes, polypropylenes, cellulose ethers and esters, such as cellulose acetate, polyacrylates, such as poly(methylmethacrylate), poly(hydroxymethacrylate), and poly(hydroxyethylacrylate) silicone-containing polymers such as polysiloxanes and the like. Biodegradable polymers such as poly(lactides), poly (glycolide), copolymers of lactides and glycolides, polyanhydrides, poly(hydroxyethylmethacrylate), poly (iminocarbonates), poly(N-acylhydroxyproline) esters, poly (N-palmitoyl hydroxyproline) esters, ethylene-vinylacetate copolymers, poly(orthoesters), poly(caprolactones), and poly(phosphazenes) are also suitable. Preferred polymers for polymeric milling media in accordance with this invention are polystyrene cross-linked with divinyl benzene, polymethylmethacrylate, and polycarbonate.

Polymeric milling media also can be composite particles having a core particle with a polymeric resin layer superposed thereon as disclosed in U.S. Pat. No. 5,478,705. Suitable core particles include those materials known to be useful as conventional milling media such as zirconium oxides stabilized with either magnesia or yttria, zirconium silicate and related phases, glass, stainless steel, titania, alumina, beria, and other ceramic materials. However, the use of dense core materials (i.e., density greater than about 3 g/cm$^3$) in polymeric milling media can result in damage to the composite conductive particles. The polymeric resin layer can be applied by various techniques well-known in the art such as spray coating, fluidized bed coating, and melt coating. Adhesion of the polymeric resin layer to the core particle can be improved by providing optional adhesion promoting or tie layers, roughening the surface of the core particle, or by corona discharge treatment, and the like. The thickness of the polymeric resin layer preferably is less than the diameter of the core particle.

Preferred polymeric milling media for use in accordance with this invention comprise poly(styrene-co-divinylbenzene)-20/80 beads prepared as described in U.S. Pat. No. 5,478,705 and European Application No. 649,858. Polymeric milling media suitable for this invention can range in size up to about 350 μm. However, to ensure production of high quality dispersions and to minimize abrasion of the conductive layer and degradation of the aspect ratio in the case of acicular composite conductive particles, media with a particle size of less than about 250 μm are preferred, less than about 100 μm are more preferred, and less than about 50 μm are most preferred. Use of milling media with a particle size less than about 5 μm also is contemplated.

The wet milling dispersion process can be performed using any suitable type of high speed disperser or media milling equipment. High speed dispersers include a simple vessel containing a high speed mixing blade, for example, a Cowles-type sawtooth impeller, rotor-stator mixers or other conventional mixers which can produce high fluid velocity and high shear. Suitable media milling equipment includes conventional mill designs such as roller mills, ball mills, stirred ball mills, attritors, horizontal media mills, vertical media mills, sand mills, pebble mills, vibratory mills, planetary mills, shaker mills, and bead mills. Processing times can range from less than 1 hour to over 100 hours depending on the particular wet milling process and equipment chosen, the surface properties of the particular particles being dispersed, the average particle aggregate/agglomerate size, the size and type of milling media, the type and level of dispersing aid(s), and other processing conditions. For ball mills, processing times from several days to weeks may be required. The use of high energy media mills can produce comparable or superior quality dispersions at substantially shorter residence times. However, the use of a high-speed disperser in a simple vessel containing the polymeric milling media is preferred for preparing dispersions of composite conductive metal-containing particles in accordance with this invention because of the simplicity of design, low cost, and ease of use. The preferred proportions of milling media, composite conductive particles, liquid vehicle, and optional dispersing aids and colloid stabilizers can vary within wide limits depending on the particular composite conductive particles selected, the size and relative density of the polymeric milling media, the type of high-speed disperser or mill selected, as well as other process-related parameters.

Polymeric film-forming binders particularly suitable for use in conductive print-retaining backing layers prepared in accordance with this invention include water insoluble, aqueous emulsions of addition-type polymers and interpolymers prepared from ethylenically unsaturated monomers such as acrylates including acrylic acid; methacrylates including methacrylic acid; alkylmethacrylates; acrylamides and methacrylamides; ethylenically unsaturated sulfonic acids; itaconic acid and its half-esters and diesters; styrenes including substituted styrenes; acrylonitrile and methacrylonitrile; vinyl acetates, vinyl ethers, vinyl and vinylidene halides, and olefins and aqueous dispersions of polyurethanes or polyesterionomers. Of these binders, a latex containing an addition product of from 30 to 78 mol % of n-butylmethacrylate, from 2 to 10 mol % of the sodium salt of 2-sulfoethyl-methacrylate, and from 20 to 65 mol % of styrene is a particularly preferred binder.

Solvents useful for preparing coatings of composite conductive particles by the method of this invention include: water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve, ethylene glycol, and mixtures thereof. Preferred solvents include water, alcohols, and acetone.

Other components that are well known in the photographic art also can be included in the coating mixture used to prepare the conductive print-retaining backing layer of this invention. Other addenda, such as surfactants or coating aids, defoaming agents, soluble antistatic agents, soluble and/or solid particle dyes, antifoggants, cross-linking agents, viscosity modifiers, lubricating agents, matting agents, and various other conventional additives optionally can be present in the coating mixture.

Suitable translucent, opaque or reflective imaging supports include paper, polyolefin-coated paper, including polyethylene-, polypropylene-, and ethylene-butylene copolymer-coated or laminated papers, synthetic papers, pigment-containing polyesters, other laminated supports, and the like. Such supports can be surface-treated by various processes including corona discharge, glow discharge, UV exposure, flame treatment, electron-beam treatment or by treatment with adhesion-promoting agents or overcoated with adhesion-promoting primer or tie layers. The preferred paper support for the present invention is polyolefin-coated photographic paper treated by corona discharge prior to applying the electrically-conductive layer on the side of the support opposite to the silver halide emulsion layer.

Coating mixtures containing a dispersion of composite conductive particles, a suitable polymeric film-forming binder, and various additives in a suitable liquid vehicle can be applied to any of the aforementioned imaging supports using any of a variety of well-known coating methods. Handcoating techniques include applying the coating mixture using a coating rod or knife or a doctor blade. Machine coating methods include air doctor coating, reverse roll coating, gravure coating, curtain coating, bead coating, slide hopper coating, extrusion coating, spin coating and the like, as well as other coating methods known in the art.

The electrically-conductive layer of this invention can be applied to the support at any suitable coverage depending on the specific requirements for the particular type of imaging element. For example, for silver halide photographic papers, dry coating weights of the preferred antimony-doped tin oxide-coated composite conductive particles in the conductive layer are preferably in the range of from about 0.01 to 3 $g/m^2$. More preferred dry coverages are in the range of about 0.05 to 1 $g/m^2$. The conductive layer of this invention typically exhibits a surface resistivity (20% RH, 20° C.) of less than $1\times10^{12}$ ohms/square, preferably less than $1\times10^{11}$ ohms/square, and more preferably less than $1\times10^{10}$ ohms/square.

In a particularly preferred embodiment, the imaging element of this invention is a photographic element that includes an image-forming layer which is a radiation-sensitive silver halide emulsion layer. Such emulsion layers typically contain a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be used alone or in combination with gelatin include dextran, gum arabic, zein, casein, pectin, collagen derivatives, collodion, agar-agar, arrowroot, albumin, and the like. Additional useful hydrophilic colloids include water-soluble polyvinyl compounds such as polyvinyl alcohol, polyacrylamide, poly (vinylpyrrolidone), and the like.

Photographic elements can be either simple black-and-white or monochrome or multilayer and/or multicolor adapted for use in a negative-positive process or a reversal process. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal elements, the emulsion layers described in U.S. Pat. No. 5,236,817, especially examples 16 and 21, are particularly suitable. Any of the known silver halide emulsion layers, such as those described in *Research Disclosure*, Vol. 176, Item 17643 (December, 1978), *Research Disclosure*, Vol. 225, Item 22534 (January, 1983), *Research Disclosure*, Item 36544 (September, 1994), and *Research Disclosure*, Item 37038 (February, 1995) and the references cited therein are useful in preparing photographic elements in accordance with this invention. Generally, the photographic element is prepared by coating one side of the support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

A preferred photographic element according to this invention includes a photographic paper bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements of the present invention can contain one or more auxiliary layers common in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. Details regarding supports and other layers of the photographic elements of this invention are contained in *Research Disclosure*, Item 389 (September, 1996), *Research Disclosure,* Item 36544 (September, 1994), and *Research Disclosure*, Item 37038 (February 1995).

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 36544 (September, 1994) and the references contained therein.

The photographic silver halide emulsions utilized in this invention can contain other addenda conventional in the photographic art. Useful addenda are described, for example, in *Research Disclosure*, Item 36544 (September, 1994). Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired. Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Imaging elements incorporating conductive backing layers of this invention also can comprise additional layers including adhesion-promoting layers, lubricant or transport-controlling layers, hydrophobic barrier layers, antihalation layers, abrasion and scratch protection layers, and other special function layers. Imaging elements incorporating conductive backing layers in accordance with this invention useful for specific imaging applications such as color and black-and-white photographic papers, electrographic media, dielectric recording media, thermally processable imaging elements, thermal dye transfer recording media, laser ablation media, inkjet media, and other imaging applications should be readily apparent to those skilled in photographic and other imaging arts.

The present invention is further illustrated by the following examples. However, the scope of this invention is by no means restricted to these illustrative examples.

Dispersion Preparation

Dispersion Sample A

An aqueous slurry containing about 20% solids by weight was prepared by combining 50 g of ZELEC® ECP 3410-T granular, electroconductive, antimony-doped tin oxide-coated titania powder (Dupont Chemicals) with 500 g deionized water by simple mixing, to which 4.4 g (2% based on the dry weight of ECP 3410-T) of a 45% aqueous solution of Dequest 2006 (Monsanto Chemical Co.) was added as a dispersing aid. This premix slurry was combined with about 275 g (300 $cm^3$) of poly(styrene-co-divinylbenzene)-20/80 milling media having a mean diameter of 50 $\mu$m. The combined mixture of slurry and milling media was agitated for 72 hours in a cylindrical 1 liter water-cooled jacketed vessel using a Dispermat laboratory-scale high-speed mixer with a Cowles-type saw tooth impeller (40 mm diameter) at an impeller shaft speed of 2000 rpm. A process temperature of nominally 20° C. was maintained throughout processing. At the end of the processing time, the dispersion of tin oxide coated titanium dioxide particles was separated from the polymeric milling media using a vacuum filtration system such as that described in U.S. Pat. No. 5,662,279. This filtered dispersion contained about 18% solids by weight. A small sample of the dispersion was evaporated to dryness. The packed powder resistivity of the resulting powder was measured by a method similar to that described in U.S. Pat. No. 5,236,737 and the result given in Table 1. The recovered electroconductive powder was analyzed for trace metals by inductively-coupled plasma atomic emission spectroscopy (ICP-AES) and the results given in Table 2.

Dispersion Sample B

An aqueous slurry containing about 12% solids by weight of FT-1000 acicular, electroconductive, antimony-doped tin oxide-coated titania powder (Ishihara Techno Corp.) was prepared as described above for Dispersion Sample A. This premix slurry was combined with about 275 g (300 $cm^3$) of poly(styrene-co-divinylbenzene)-20/80 milling media having a mean diameter of 50 $\mu$m and processed as for Dispersion Sample A except for only 48 hours. At the end of the processing time, the dispersion of tin oxide-coated acicular titanium dioxide particles was separated from the polymeric milling media using a vacuum filtration system as described for Dispersion Sample A. This dispersion contained about 12% solids by weight. A small sample of the dispersion was evaporated to dryness. The packed powder resistivity of the acicular FT-1000 particles recovered from the dispersion was measured and the value given in Table 1. The recovered electroconductive powder was analyzed for trace metals by ICP-AES and the results given in Table 2.

Dispersion Sample C

An aqueous slurry containing about 20% solids by weight ZELEC® ECP 3410-T granular electroconductive powder was prepared as described above for Dispersion Sample A. This premix slurry was combined with about 700 g (300 $cm^3$) of zirconium silicate milling media having a mean diameter of about 50 $\mu$m and processed as in Dispersion Sample A but only for 24 hours. At the end of the processing time, the dispersion of tin oxide-coated titanium dioxide particles was separated from the milling media using a vacuum filtration system as described for Dispersion Sample A. This dispersion contained about 21% solids by weight. A small sample of the dispersion was evaporated to dryness. The packed powder resistivity of the ECP 3410-T particles recovered from this dispersion were measured and the value given in Table 1. X-ray fluorescence analysis revealed the presence of zirconium as a major contaminant The powder also was analyzed for trace metals by ICP-AES and the results given in Table 2.

Dispersion Sample D

An aqueous slurry containing about 20% solids by weight FT-1000 acicular electroconductive powder was prepared as described above for Dispersion Sample A. This premix slurry was combined with about 700 g (300 $cm^3$) of zirconium silicate milling media having a mean diameter of about 50 $\mu$m and processed for 24 hours as for Dispersion Sample C. At the end of the processing time, the dispersion of tin oxide-coated acicular titanium dioxide particles was separated from the milling media using a vacuum filtration system as described for Dispersion Sample A. This dispersion contained about 18% solids by weight. A small sample of the dispersion was evaporated to dryness. The packed powder resistivity of the acicular FT-1000 particles recovered from this dispersion was measured and the value given in Table 1. X-ray fluorescence analysis revealed the presence of zirconium as a major contaminant. The powder also was analyzed for trace metals by ICP-AES and the results given in Table 2.

TABLE 1

Dispersions of composite conductive particles

| Dispersion Sample | Processing Time (hr) | Media Type | % Solids | Powder Resist (ohm · cm) |
|---|---|---|---|---|
| A | 72 | polymeric | 17.8 | 30 |
| B | 48 | polymeric | 12.0 | 35 |
| C | 24 | 50 $\mu$m $ZrSiO_4$ | 21.1 | 5800 |
| D | 24 | 50 $\mu$m $ZrSiO_4$ | 17.9 | 280 |

TABLE 2

Trace metal analysis of dispersions by ICP/AES

| Dispersion Sample | A | B | C | D | ECP 3410-T | FT1000 |
|---|---|---|---|---|---|---|
| Zr* | <30 | 190 | 9500 | 11000 | <30 | 200 |
| Si* | 11000 | <300 | 13000 | <300 | 15000 | <300 |
| Al* | 3700 | 270 | 4000 | 280 | 4000 | 280 |
| Fe* | 2000 | 480 | 1600 | 1100 | 73 | 70 |
| Cr* | 470 | 120 | 430 | 310 | <30 | <30 |
| Ni* | 270 | 47 | 190 | 110 | <30 | <30 |
| Mn* | 35 | <30 | 32 | <30 | <30 | <30 |

*Contaminant levels are given in units of $\mu$g/g.

The use of polymeric milling media produces less degradation of the electrical conductivity of the composite conductive particles based on the observed packed powder resistivity values. These packed powder resistivity values are much lower than those obtained for samples processed for 24 hours using 50 $\mu$m $ZrSiO_4$ milling media. Contamination levels of Zr from the $ZrSiO_4$ media and Fe, Cr, Ni, and Mn resulting from wear of the stainless steel components of the milling equipment are typically less for dispersions prepared in accordance with this invention using polymeric media. Similar decreases in contamination levels for dispersions of other materials useful in imaging elements prepared using polymeric media have been described in U.S. Pat. No. 5,478,705. However, in some cases, the composite conductive particles can be sufficiently abrasive themselves to cause wear of the stainless steel components of the milling equipment, especially at very long dispersion times (e.g., >48 hours) as in the case of Dispersion A. When ceramic milling media were used in the dispersion process, the rate of wear of the stainless steel components of the milling equipment was greatly accelerated as demonstrated by the Fe, Cr, and Ni levels of Dispersion D processed for only 24 hours which are about 2.5 times those of Dispersion B processed for 48 hours.

Test Methods

Surface Resistivity Measurement

Samples of paper support having a conductive backing layer were preconditioned at 50% RH and 72° F. for at least 24 hours prior to testing. Surface electrical resistivity (SER) was measured using a Keithley Model 616 digital electrometer by a two-point DC probe method similar to that described in U.S. Pat. No. 2,801,191.

Backmark Retention Test

Printed text was applied to the conductive backing layer of a sample of polyolefin resin-coated paper using a dot matrix ribbon printer. Next, the paper sample was immersed in a conventional developer solution (KODAK RA 100) for 30 seconds, washed with warm water for 5 seconds and rubbed to evaluate print retention. The following qualitative ratings were assigned, with values of 1–3 representing acceptable performance for polyolefin resin-coated photographic papers.

1=Outstanding, very little difference between processed and unprocessed appearance 2=Excellent, slight degradation of appearance 3=Acceptable, moderate degradation of appearance 4=Unacceptable, serious degradation of appearance 5 =Unacceptable, total degradation of appearance

EXAMPLES 1–3

Aqueous coating mixtures containing Dispersion A and a latex copolymer A having the composition: 30 mol % styrene-60 mol % n-butylmethacrylate-10 mol % sodium 2-sulfoethyl methacrylate (prepared as described in U.S. Pat. No. 5,244,728) were prepared at nominally 4% total solids. The weight ratios of conductive particles to co-polymer latex binder were nominally 70:30, 60:40, and 50:50 for the conductive backing layers of Examples 1, 2, and 3, respectively. These ratios expressed in terms of volume percentages of composite conductive particles are given in Table 3. The coating mixtures were applied to one side of samples of corona discharge-treated polyethylene-coated photographic paper using a coating rod and dried for 5 minutes at 180° F. to provide nominal total dry weight coverages of 650 mg/m$^2$. The surface electrical resistivity (SER) was measured as described hereinabove for the conductive backing layers before ("raw") and after ("processed") treatment with developing solution. Backmark retention was evaluated as described hereinabove. Descriptions of the backing layers, SER (raw) and SER (processed) values, and backmark retention properties are summarized in Table 3.

EXAMPLES 4–6 (a–b)

Aqueous coating mixtures containing Dispersion B and latex copolymer A were prepared at nominally 4% total solids as described for Examples 1–3. The weight ratios of conductive particles to co-polymer latex binder were nominally 70:30, 60:40, and 50:50 for the conductive backing layers of Examples 4, 5, and 6, respectively. These ratios expressed in terms of volume percentages of composite conductive particles are given in Table 3. The coating mixtures were applied to one side of samples of corona discharge-treated polyethylene-coated photographic paper as described for Examples 1–3 to provide nominal total dry weight coverages of 650 mg/m$^2$ (Examples 4a, 5a, 6a) and 430 mg/m$^2$ (Examples 4b, 5b, 6b). Descriptions of the backing layers, SER (raw) and SER (processed) values, and backmark retention properties are summarized in Table 3.

Comparative Examples 1–3 (a–b)

Aqueous coating mixtures containing Dispersion C and latex copolymer A were prepared at nominally 4% total solids. The weight ratios of conductive particles to copolymer latex binder were nominally 70:30, 60:40, and 50:50 for the conductive backing layers of Comparative Examples 1, 2, and 3, respectively. These ratios expressed in terms of volume percentages of composite conductive particles are given in Table 3. The coating mixtures were applied to one side of samples of corona discharge-treated polyethylene-coated photographic paper to provide nominal dry weight coverages of 650 mg/m$^2$ (Comp. Ex. 1a, 2a, 3a) and 430 mg/m$^2$ (Comp. Ex. 1b, 2b, 3b) as described for Examples 1–3. Descriptions of the backing layers, SER (raw) and SER (processed) values, and backmark retention properties are summarized in Table 3.

Comparative Examples 4–6

Aqueous coating mixtures containing Dispersion D and latex copolymer A were prepared at nominally 4% total solids as described for Comparative Examples 1–3. The weight ratios of conductive particles to copolymer latex binder were nominally 70:30, 60:40, and 50:50 for the conductive backing layers of Comparative Examples 4, 5, and 6, respectively. These ratios expressed in terms of volume percentages are given in Table 3. The coating mixtures were applied to one side of samples of corona discharge-treated polyethylene-coated photographic paper as described for Examples 1–3 to provide a nominal dry weight coverage of 430 mg/m$^2$. Descriptions of the backing layers, SER (raw) and SER (processed) values, and backmark retention properties are summarized in Table 3.

Comparative Example 7

A coating mixture containing latex copolymer A at 4% total solids in water was applied to one side of a sample of corona discharge-treated polyethylene-coated photographic paper as described hereinabove to provide a nominal total dry weight coverage of 430 mg/M$^2$. SER (raw) and SER (processed) values, and backmark retention properties are summarized in Table 3.

Comparative Example 8

A coating mixture was prepared in accordance with Example 1 of U.S. Pat. No. 5,244,728 and applied to the backside of a corona discharge-treated photographic paper having a polyethylene layer on both sides thereof at a nominal total dry weight coverage of 430 mg/M$^2$ to provide a print retaining conductive backing layer. SER was measured before ("raw") and after ("processed") exposure to developing solution, backmark retention was evaluated, and the results summarized in Table 3.

Comparative Example 9

A coating mixture was prepared in accordance with a formulation disclosed in Example 6 of U.S. Pat. No. 3,525,621 and applied to the backside of a corona discharge-treated photographic paper having a polyethylene layer on both sides thereof at a nominal total dry weight coverage of 320 mg/m$^2$ to provide a print-retaining conductive backing layer. SER was measured before ("raw") and after ("processed") exposure to developing solution, backmark retention was evaluated, and the results summarized in Table 3.

TABLE 3

Properties of conductive backings containing composite conductive particles

| Sample No. | Dispersion | Particle Type | Media Type | Coverage (mg/m$^2$) | % Particle weight | % Particle volume | Raw SER (log Ω/sq) | Procd SER (log Ω/sq) | Back Mark Retention |
|---|---|---|---|---|---|---|---|---|---|
| Example 1 | A | ECP-3410-T | polymeric | 650 | 70 | 35.4 | 6.4 | 7.9 | 1 |
| Example 2 | " | " | " | 650 | 60 | 26.1 | 8.0 | 9.3 | 1 |
| Example 3 | " | " | " | 650 | 50 | 19.0 | 11.3 | 11.8 | 1 |
| Example 4a | B | FT-1000 | " | 650 | 70 | 37.1 | 7.2 | — | 2 |
| Example 4b | " | " | " | 430 | 70 | 37.1 | 7.7 | — | 3 |

TABLE 3-continued

Properties of conductive backings containing composite conductive particles

| Sample No. | Dispersion | Particle Type | Media Type | Coverage (mg/m$^2$) | % Particle weight | % Particle volume | Raw SER (log Ω/sq) | Procd SER (log Ω/sq) | Back Mark Retention |
|---|---|---|---|---|---|---|---|---|---|
| Example 5a | " | " | " | 650 | 60 | 27.5 | 6.0 | 6.3 | 2 |
| Example 5b | " | " | " | 430 | 60 | 27.5 | 7.5 | 7.2 | 1 |
| Example 6a | " | " | " | 650 | 50 | 20.2 | 7.5 | 6.7 | 1 |
| Example 6b | " | " | " | 430 | 50 | 20.2 | 8.3 | 7.5 | 2 |
| Comp Ex 1a | C | ECP-3410-T | ZrSiO4 | 650 | 70 | 35.4 | 10.9 | 13.6 | 2 |
| Comp Ex 1b | " | ECP-3410-T | " | 430 | 70 | 35.4 | 10.6 | 13.7 | 2–3 |
| Comp Ex 2a | " | ECP-3410-T | " | 650 | 60 | 26.1 | 10.9 | 12.5 | 2 |
| Comp Ex 2b | " | ECP-3410-T | " | 430 | 60 | 26.1 | 11.0 | 13.9 | 2 |
| Comp Ex 3a | " | ECP-3410-T | " | 650 | 50 | 19.0 | 10.6 | >13.9 | 2 |
| Comp Ex 3b | " | ECP-3410-T | " | 430 | 50 | 19.0 | 10.9 | >13.9 | 2 |
| Comp Ex 4 | D | FT-1000 | " | 430 | 70 | 37.1 | 10.6 | 11.1 | 2 |
| Comp Ex 5 | " | " | " | 430 | 60 | 27.5 | 10.7 | 11.7 | 2 |
| Comp Ex 6 | " | " | " | 430 | 50 | 20.2 | 10.5 | 13.7 | 1 |
| Comp Ex 7 | — | none | — | 430 | 0 | 0 | 10.8 | >13.9 | 1 |
| Comp Ex 8 | — | Ludox AM | — | 430 | | | 10.9 | >13.9 | 1 |
| Comp Ex 9 | — | Ludox AM | — | 320 | | | 12.2 | 12.8 | 4 |

The improvement in surface resistivity (SER) of print-retaining conductive backing layers resulting from using polymeric media to prepare dispersions of composite conductive particles in accordance with this invention is clearly demonstrated by the SER data presented in Table 3. For example, the conductive backing of Example 1 is substantially more conductive than that of Comparative Example 1a for the same total dry weight coverage and volume percentage of composite conductive particles. Similarly, the conductive backing of Example 6b is substantially more conductive than that of Comparative Example 6 for the same total dry weight coverage and volume percentage of composite conductive particles. In fact, the SER of the backing layer of Comparative Examples 1a and 6 are more comparable to that of the backing layer of Comparative Example 7 which contains only the latex copolymer binder or Comparative Example 8 which contains colloidal silica (i.e., LUDOX AM) and ionic antistatic agents in combination with the latex copolymer binder. The SER values for the backings of Examples 1–3 and 5–6 exhibit only slight (<1.5 log Ω/sq) increases in SER after treatment with developer solution whereas the backings of Comparative Examples 1–6 typically exhibit much larger increases in SER values (>3 log Ω/sq) after treatment with developer solution and for particle volume percentages of less than about 25%, are nonconductive. Similarly, after treatment with developer solution, the backings of Comparative Examples 7 and 8 are nonconductive. As disclosed in U.S. Pat. No. 5,719,016, backing layers of this invention containing acicular composite conductive particles also are more conductive than those containing granular composite conductive particles at comparable total dry weight coverage and volume percentage of particles, especially for low volume percentages (e.g., backings of Examples 3 and 6a). The backmark retention properties of backing layers of this invention are comparable or superior to those of backing layers containing composite conductive particles dispersed by ceramic media for particle volume percentages less than about 30%.

The invention has been described in detail with particular reference to certain preferred embodiments thereof, but it will be understood that variations and modifications can be effected within the spirit and scope of the invention.

What is claimed is:

1. An imaging element comprising:

a support having a frontside and a backside;

an imaging layer superposed on the frontside of said support;

and a print-retaining, electrically-conductive outermost layer superposed on the backside of said support comprising a film-forming binder comprising the latex polymeric addition product of from 20 to 65 mol % of styrene, from 30 to 78 mol % of n-butyl methacrylate, and from 2 to 10 mol % of the sodium salt of 2-sulfoethyl methacrylate and composite electrically conductive particles comprising a layer of electrically conductive metal-containing crystallites overlying a nonconductive substrate particle, said electrically-conductive layer comprising at least about 60 weight percent of said composite electrically conductive particles;

wherein the electrically-conductive layer is formed by dispersing the composite electrically-conductive particles using polymeric milling media having a mean particle size less than 350 $\mu$m to form a colloidal dispersion, combining the colloidal dispersion with the film forming binder to form a mixture, coating the mixture onto the support and drying the mixture to form the electrically conductive layer.

2. The imaging element of claim 1 wherein said support comprises paper, synthetic paper, laminated paper or resin-coated paper.

3. The imaging element of claim 1 wherein said composite electrically-conductive particles further comprise an optional intermediate layer containing amorphous or crystalline metal-containing particles interposed between said nonconductive substrate particle and said layer of electrically-conductive crystallites.

4. The imaging element of claim 1 wherein said electrically-conductive composite particles are spherical, granular, platey, lamellar, fibrous or acicular in shape.

5. The imaging element of claim 3 wherein said nonconductive substrate particles are selected from the group consisting of silica, titania, alumina, iron oxide, tin oxide, barium titanate, strontium titanate, calcium titanate, magnesium titanate, dipotassium hexatitanate, disodium hexatitanate, barium sulfate, calcium sulfate, barium carbonate, aluminum borate, talc, mica, illite, bravaisite, kaolin, bentonite, montmorillonite, hectorite, synthetic smectite clay, and glass.

6. The imaging element of claim 3 wherein said electrically-conductive, metal-containing crystallites are selected from the group consisting of antimony-doped tin oxide, fluorine-doped tin oxide, tin-doped indium sesquioxide, niobium-doped titanium oxide, aluminum-doped zinc oxide, zinc antimonate, indium antimonate, cadmium stannate, cadmium indate, cadmium indium stannate, cadmium antimony stannate, indium gallium oxide, metal carbides, metal nitrides, metal silicides, and metal borides.

7. The imaging element of claim 3 wherein said intermediate layer is selected from the group consisting of silica, titania, zirconia, alumina, tin oxide, antimony oxide, and zinc oxide.

8. The imaging element of claim 1 wherein the electrically-conductive layer has a dry weight coverage of electrically-conductive, metal-containing composite particles of from 0.01 to 3 $g/m^2$.

9. The imaging element of claim 1 wherein the electrically-conductive, metal-containing composite particles comprise from 5 to 70 volume percent of the print-retaining, electrically-conductive layer.

10. The imaging element of claim 1 wherein the electrically-conductive, metal-containing composite particles exhibit a packed-powder specific (volume) resistivity of $1\times10^3$ ohm-cm or less.

11. The imaging element of claim 6 wherein said electrically-conductive, metal-containing crystallites comprise antimony-doped tin oxide.

12. The imaging element of claim 1 wherein the polymeric milling media comprise cross-linked polystyrene, styrene copolymers, polycarbonates, vinyl acetals, vinyl chloride polymers, polyurethanes, polyaramides, high density polyetheylenes, polypropylenes, polyacrylates or fluoropolymers.

13. The imaging element of claim 1, wherein the polymeric milling media have a mean particle size less than or equal to 50 $\mu$m.

14. A photographic paper comprising:

a resin-coated paper support having a front side and a backside;

a silver halide emulsion layer superposed on the front side of the support;

a print-retaining, electrically-conductive outermost layer superposed on the backside of said support comprising a film-forming binder comprising the latex polymeric addition product of from 20 to 65 mol % of styrene, from 30 to 78 mol % of n-butyl ethacrylate, and from 2 to 10 mol % of the sodium salt of 2-sulfoethyl methacrylate and composite electrically conductive particles comprising a layer of electrical conductive metal-containing crystallites overlying a nonconductive substrate particle, said electrically-conductive layer comprising at least about 60 weight percent of said composite electrically conductive particles;

wherein the electrically-conductive layer is formed by dispersing composite electrically-conductive particles using polymeric milling media having a mean particle size less than 350 $\mu$m to form a colloidal dispersion, combining the colloidal dispersion with the film forming binder to form a mixture, coating the mixture onto the support and drying the mixture to form the electrically-conductive layer.

15. An inkjet image-receiving element comprising:

a support having a frontside and a backside;

an image-receiving layer superposed on the frontside of the support;

a print-retaining, electrically-conductive outermost layer superposed on the backside of said support comprising a film-forming binder comprising the latex polymeric addition product of from 20 to 65 mol % of styrene, from 30 to 78 mol % of n-butyl methacrylate, and from 2 to 10 mol % of the sodium salt of 2-sulfoethyl methacrylate and composite electrically conductive particles comprising a layer of electrically conductive metal-containing crystallites overlying a nonconductive substrate particle, said electrically-conductive layer comprising at least about 60 weight percent of said composite electrically conductive particles;

wherein the electrically-conductive layer is formed by dispersing the composite electrically-conductive particles using polymeric milling media having a mean particle size less than 350 $\mu$m to form a colloidal dispersion, combining the colloidal dispersion with the film forming binder to form a mixture, coating the mixture onto the support and drying the mixture to form the electrically conductive layer.

16. A thermal dye transfer recording element comprising:

a support having a frontside and a backside;

a dye-receiving layer superposed on the frontside of the support;

a print-retaining, electrically-conductive outermost layer superposed on the backside of said support comprising a film-forming binder comprising the latex polymeric addition product of from 20 to 65 mol % of styrene, from 30 to 78 mol % of n-butyl methacrylate, and from 2 to 10 mol % of the sodium salt of 2-sulfoethyl methacrylate and composite electrically conductive particles comprising a layer of electrically conductive metal-containing crystallites overlying a nonconductive substrate particle, said electrically-conductive layer comprising at least about 60 weight percent of said composite electrically conductive particles;

wherein the electrically-conductive layer is formed by dispersing the composite electrically-conductive particles using polymeric milling media having a mean particle size less than 350 $\mu$m to form a colloidal dispersion, combining the colloidal dispersion with the film forming binder to form a mixture, coating the mixture onto the support and drying the mixture to form the electrically conductive layer.

17. The imaging element of claim 1 wherein said film-forming binder comprises the latex polymeric addition product of 30 mol % of styrene, 60 mol % of n-butyl methacrylate, and 10 mol % of the sodium salt of 2-sulfoethyl methaerylate.

18. The photographic paper of claim 14 wherein said film-forming binder comprises the latex polymeric addition product of 30 mol % of styrene, 60 mol % of n-butyl methacrylate, and 10 mol % of the sodium salt of 2-sulfoethyl methacrylate.

19. The inkjet image-receiving element of claim 15 wherein said film-forming binder comprises the latex polymeric addition product of 30 mol % of styrene, 60 mol % of n-butyl methacrylate, and 10 mol % of the sodium salt of 2-sulfoethyl methacrylate.

20. The thermal dye transfer element of claim 16 wherein said film-forming binder comprises the latex polymeric addition product of 30 mol % of styrene, 60 mol % of n-butyl methacrylate, and 10 mol % of the sodium salt of 2-sulfoethyl methacrylate.

* * * * *